US005533561A

United States Patent [19]

Forehand, IV

[11] Patent Number: 5,533,561

[45] Date of Patent: Jul. 9, 1996

[54] GARAGE DOOR SECURITY SYSTEM

[76] Inventor: L. Langstroth Forehand, IV, 848 Harding St., Escondido, Calif. 92027

[21] Appl. No.: 976,002

[22] Filed: Nov. 12, 1992

Related U.S. Application Data

[63] Continuation of Ser. No. 705,290, May 24, 1992, abandoned.

[51] Int. Cl.[6] ..... E05F 15/00

[52] U.S. Cl. ..... 160/188; 49/280; 160/201; 292/DIG. 36

[58] Field of Search ..... 160/188, 201; 49/199, 280; 70/DIG. 11; 292/DIG. 36

[56] References Cited

U.S. PATENT DOCUMENTS

| | | | |
|---|---|---|---|
| 1,908,165 | 5/1933 | Moler | 292/DIG. 36 X |
| 2,530,629 | 11/1950 | Pringle . | |
| 2,607,586 | 8/1952 | Schlytern . | |
| 3,096,815 | 7/1963 | May . | |
| 3,426,829 | 2/1969 | McDaniel et al. | 160/201 |
| 3,797,171 | 3/1974 | Farmer | 160/188 X |
| 3,933,382 | 1/1976 | Counts et al. | 160/201 X |
| 4,254,582 | 3/1981 | McGee . | |
| 4,771,218 | 9/1988 | McGee . | |
| 4,819,379 | 4/1989 | Kenzelmann et al. . | |
| 4,905,542 | 3/1990 | Burm et al. | 160/188 X |

*Primary Examiner*—Ramon O. Ramirez
*Assistant Examiner*—Derek J. Berger
*Attorney, Agent, or Firm*—John J. Byrne

[57] ABSTRACT

A garage door-opener security system which automatically positively blocks any unauthorized opening of a sectional garage door that travels, guided by rollers, in a pair of flanking metal guide tracks. The security system is interconnected with a standard, automatic, garage door-opening mechanism that includes an electric drive motor. When the door reaches its fully closed position, a locking device, mounted adjacent one of the flanking tracks, physically inserts a locking pin into the trackway in which the rollers move, which pin is located a few inches above the roller next below. The locking pin is closely confined by a surrounding aperture which prevents its upward deflection or twisting, thus making it impossible for the roller to move therepast in the trackway and positively preventing the raising of the door more than a few inches. Upon the application of electrical power to the motor to drive the door to its open position, the locking pin is automatically immediately withdrawn to permit the normal operation of the door. In the case of power failure, an element is provided for disabling the locking device.

6 Claims, 2 Drawing Sheets

FIG. 1
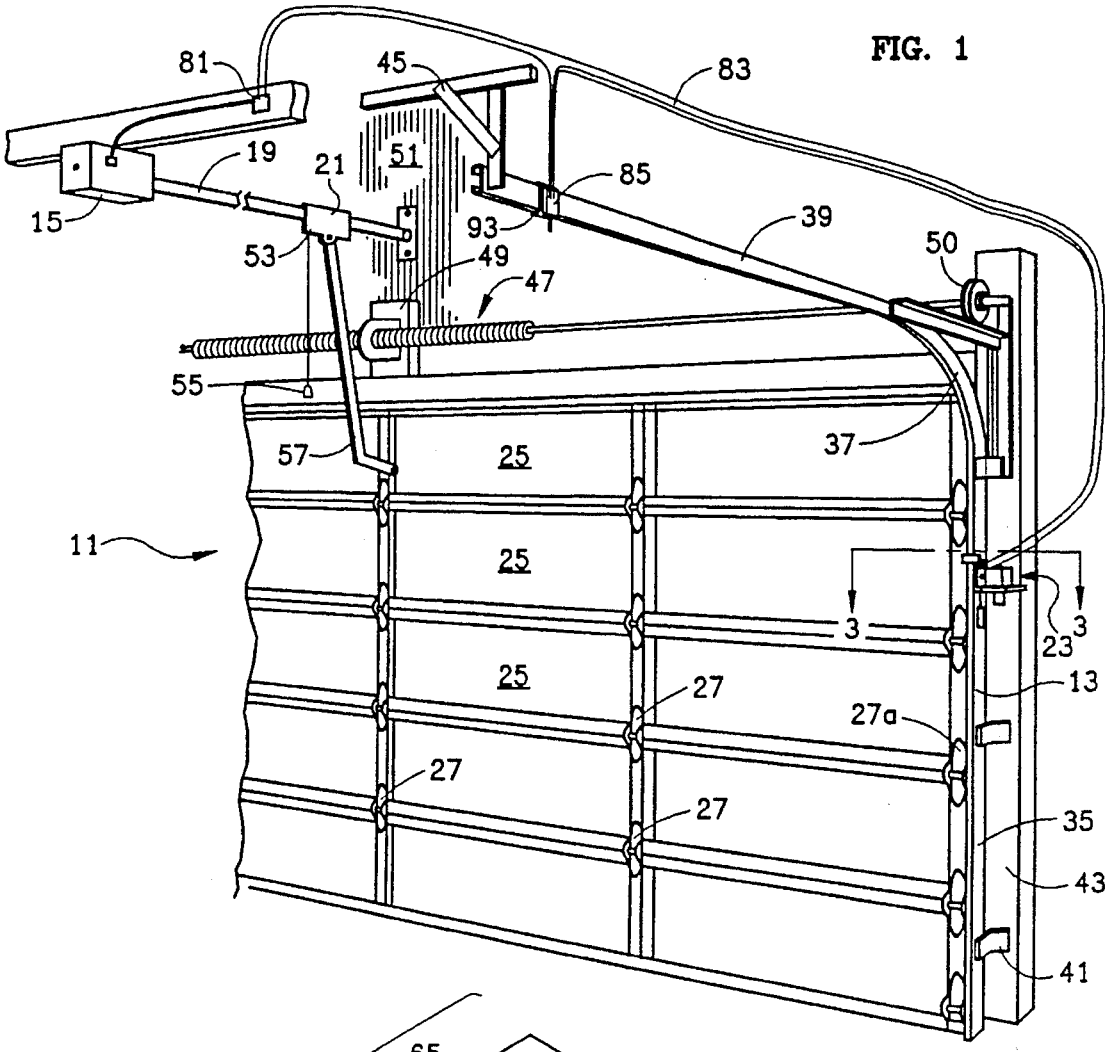
FIG. 2
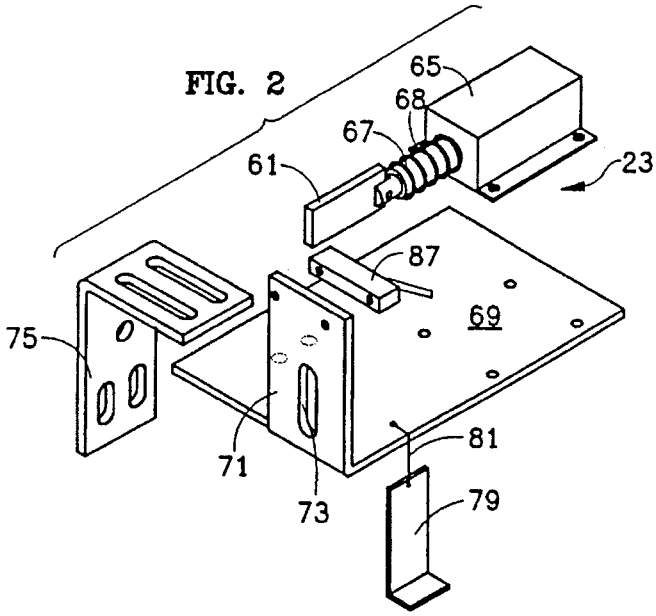
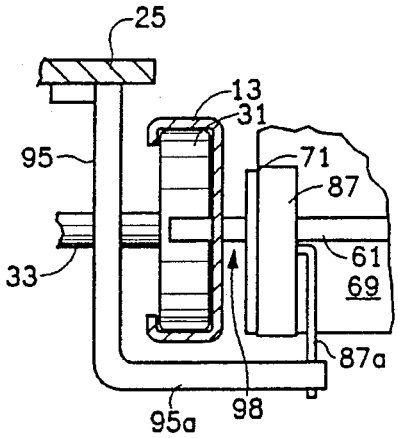
FIG. 3

GARAGE DOOR SECURITY SYSTEM

This application is a continuation of application Ser. No. 07/705,290, filed May 24, 1992, abandoned.

This invention relates to garage door security systems and more particularly to electrical systems for positively preventing unauthorized access to a garage having a sectional door that travels in a pair of flanking tracks to open and close the vehicle entrance thereto.

BACKGROUND OF THE INVENTION

For years, the problem of preventing unauthorized access to a garage having an overhead door equipped with an automatic door opening and closing system has been of concern to the general populace. A wide variety of attempts have been made to, in some manner, disable such an automatic garage door opening mechanism in order to prevent unauthorized access. Representative of these attempts are those generally exemplified by the teachings of U.S. Pat. Nos. 2,530,629; 2,607,586; 4,254,582; 4,771,218 and 4,819,379. It has also been common to provide various key-locking devices for securing a door in its closed position; however, these devices have usually required the manual turning of a key and the consequent inconvenience involved with it. None of the foregoing attempts has been fully satisfactory for sectional garage doors, and as a result, more effective, more convenient arrangements have continued to be sought.

SUMMARY OF THE INVENTION

The invention provides an automatically operable garage door security system which positively blocks the unauthorized opening of a sectional garage door that travels upward and downward guided by supporting rollers which move in a pair of flanking tracks. The system works in combination with a standard automatic electric garage door opening device that drives the door upward or downward when a drive motor is actuated in response to receipt of an electrical signal usually generated by a manual push-button or by a radio transmitter type control. Mounted on one of the flanking tracks is a locking mechanism which physically inserts a detent or pin through the track. When the detent is in its locking position, it physically blocks the rollers which support the sectional door from moving past that point, thus positively disabling the door and preventing entry through the vehicle entrance until the detent is withdrawn. The system is designed such that the detent is automatically inserted into its locking position when the door reaches either its open or closed limit positions and is automatically withdrawn from the locking position when power is again applied to the door opener motor following receipt of an electrical control signal to begin the next opening or closing cycle. In the case of a power loss, the detent can be manually withdrawn, and a blocking element is provided for temporarily locating it in a nonlocking position, so that the door can be manually opened from the inside of the garage after disconnection via a standard manually disengagable coupling, of a link and bent arm mechanism by which the door is connected to the power train of the automatic garage door driving arrangement.

BRIEF DESCRIPTION OF THE DRAWINGS

FIG. 1 is a perspective view of a garage door installation wherein there is installed a security system embodying various features of the invention;

FIG. 2 is an exploded perspective view, enlarged in size, showing the locking device that forms a part of the system shown in FIG. 1;

FIG. 3 is a fragmentary sectional view taken generally along the line 3—3 of FIG. 1 showing the installation when the door is in the fully closed position;

DETAILED DESCRIPTION OF THE PREFERRED EMBODIMENTS

Figure 4:
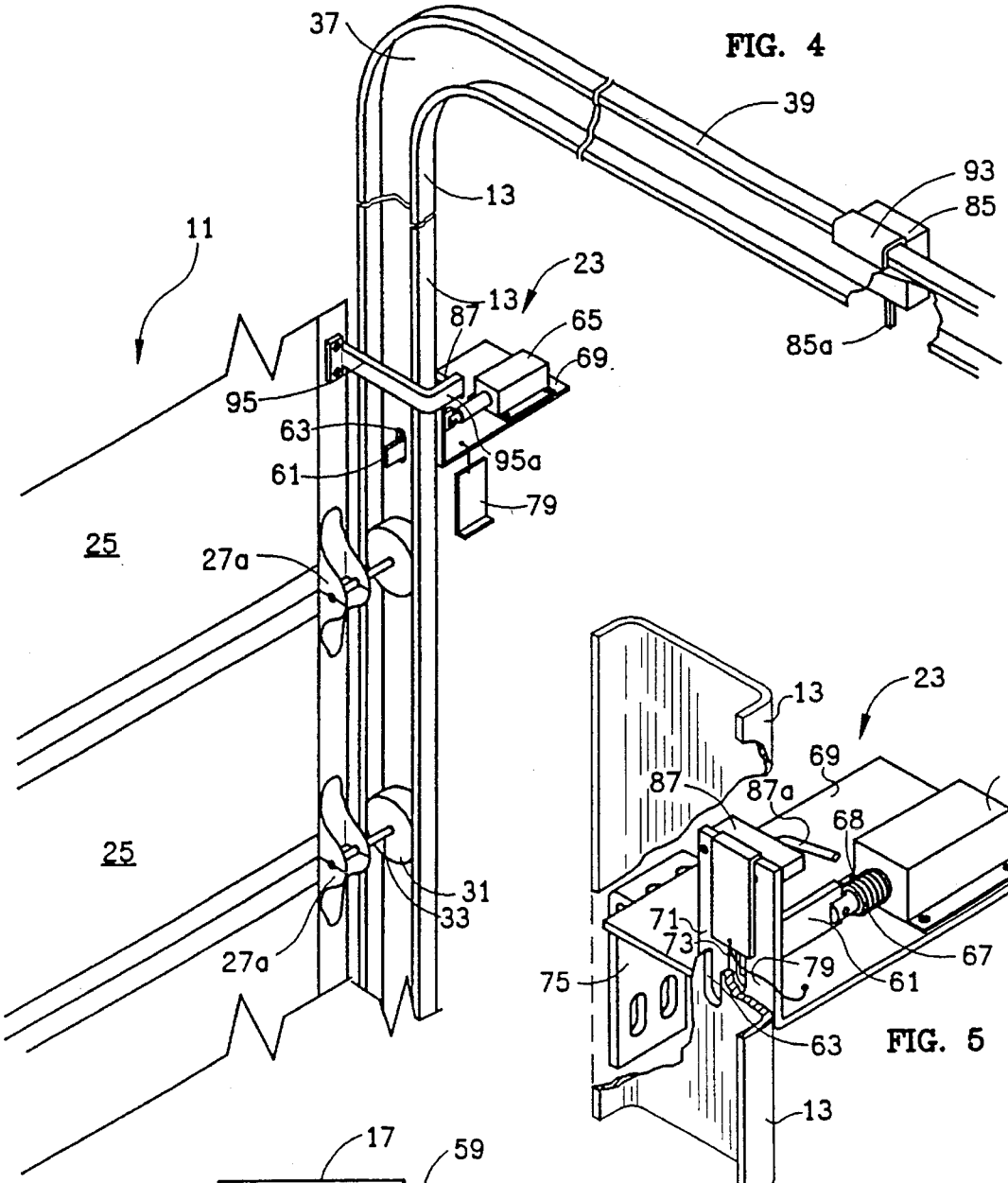
FIG. 4 is an enlarged fragmentary perspective view, taken from a different angle, of the installation shown in FIG. 1.

Illustrated in the drawings is a standard overhead garage door 11 which is automatically operable to open and close the vehicle entrance to a private garage or the like. The installation includes a sectional garage door 11 which is guided in its travel between open and closed positions by a set of flanking rails or tracks 13 extending between about the floor of the garage and an overhead location. Movement of the door is powered by a standard garage door operating mechanism 15 including an electric motor assembly 15 which is controlled by the usual control system 17 that will usually include a connection to a wall-mounted push-button switch (not shown) and a radio receiver for receiving a signal from a hand-held transmitter or the like. The operating mechanism motor assembly 15 drives a power train to which there is detachably connected a linkage mechanism 21 that is pivotally connected to the garage door 11. Mounted adjacent one of the tracks 13 is a locking device 23 security system which is electronically interconnected to the door opener actuating circuitry 17.

More specifically, the installation illustrated is in the environment of a usual residential garage of the type designed to house two automotive vehicles; however, it is equally applicable for use with a door that closes a single-car garage. The multiple panel door 11 is designed to close the vehicle entrance to such a garage and thereby secure the contents of the garage against unauthorized entry from the exterior. The multiple panel door is accordingly of an appropriate size to completely close the totality of the entrance, and it is in the form of a plurality of substantially identical horizontally extending panels 25 which are hinged to one another by hinges 27 and 27*a* located at spaced-apart locations along the upper and/or lower edges thereof at a sufficient number of points so as to provide integrity of the overall closure. The hinged-together door 11, at each hinge 27*a* along both lateral edges and at the bottom of the door, contains guide rollers 31 which support and guide the lateral edges of the door 11. The guide rollers 31 are carried by stub shafts 33 on which they rotate, which stub shafts are received in and operate as the hinge pins for the hinges 27*a*.

The guide rollers 31 are individually received within the trackway of one of the pairs of metal tracks 13 which each have a vertical section 35 flanking the entrance into the structure, a center arcuate section 37 and an upper horizontal section 39. These tracks 13 appropriately define the path of the multiple panel door 11 as it moves to and from between a lower closed position and an upper open position. The tracks 13 are standard components for mounting an overhead multi-panel door of this general type and they are appropriately mounted by brackets 41 to one of the wooden posts 43 which define the lateral boundaries of the vehicle entrance and by struts 45 usually connected to a beam or joist in the garage superstructure. The door 11 is counterbalanced using a standard rod and torsion spring arrangement 47 mounted on the header 49 above the entrance which includes a spool of thin wire cable 50 that is at each lateral side of the door. This counterbalance mechanism is well known and standard in the art and forms no part of the present invention.

The door 11 is mounted on the rear side of a door frame which includes the posts 43, in a suitable fashion so that it can be moved from its generally vertical, closed position shown in FIGS. 1 and 3 to an overhead open position where it permits free passage to a vehicle through the door entrance. In the closed position, the lower edge of the door 11 preferably contacts the floor, and its upper edge preferably contacts the upper edge of the door frame, thus sealing the entrance.

Any suitable electrically actuatable garage door opening mechanism can be employed, such as one which includes a guide track 19 mounted at its forward end to the rear surface of the front wall 51 of the garage above the opening defined by the door frame, and at its rear end to the housing containing the opener motor arrangement 15, all as well known in this art. The electric motor arrangement 15 is suitably supported from the ceiling or the roof of the garage or from overhead support members in the garage by a strut assembly (not shown) so as to mount it at the desired overhead location. The motor assembly 15 can drive a roller chain which travels along the track 19 to open and close the door. A traveler link 53 is detachably connected to the roller chain so as to move along the track with the chain when the garage door opener motor is operating; however, it is provided with the usual manual disconnection arrangement, e.g. a pull cord and handle 55, so that, in case of a power failure, it can be disconnected by a person in the interior of the garage, thereby allowing the door to be manually opened. The traveler link 21 is connected to a bent arm 57 which is pivotally connected to the rear surface of the upper panel of the door as is also standard in this art.

The usual control mechanism which includes the door opener electrical circuitry 17 is provided so as to alternately drive the opener motor in opposite directions of rotation so that the sectional panel door 11 can be alternately closed and opened. The control circuitry includes, in its standard form, a connection to a pushbutton switch or the like mounted on a wall of the interior of the garage, allowing a person within the garage to instigate either opening or closing motion, as well as a connection to a suitable source of electrical power, such as to a 110–120 volt household circuit 59 which supplies the required power to operate the opener motor and the various circuits included therewithin. In addition to the pushbutton connection, the door opener circuitry includes a radio receiver which is designed, upon receipt of a coded signal (from a hand-held actuator or the like, normally maintained at a convenient location in the vehicle to allow the driver to send a radio signal), to cause the door to either open or close as desired. All this is standard in the art, and a suitable remote actuator, preferably a radio transmitter, is employed.

The locking device 23 to secure the garage door against unauthorized entry is mounted on the post 43 adjacent the track 13 and is constructed so as to cause a locking pin or detent 61 to be inserted physically into the trackway a pre-determined distance above a roller 31 so as to positively prevent the movement of the roller 31 past the point of penetration of the locking pin 61 unless the pin has been withdrawn prior to the roller reaching this location. Accordingly, an aperture 63 in the track that provides access to the trackway is provided, and the locking device is aligned so that the locking pin 61, in an extended position, passes through the aperture 63 at a position just below the upper edge wall of the aperture. The locking device 23 is electrically controlled so as to cause the pin 61 to be withdrawn as soon as the door opener motor causes the door 11 to begin to move.

Figure 5:
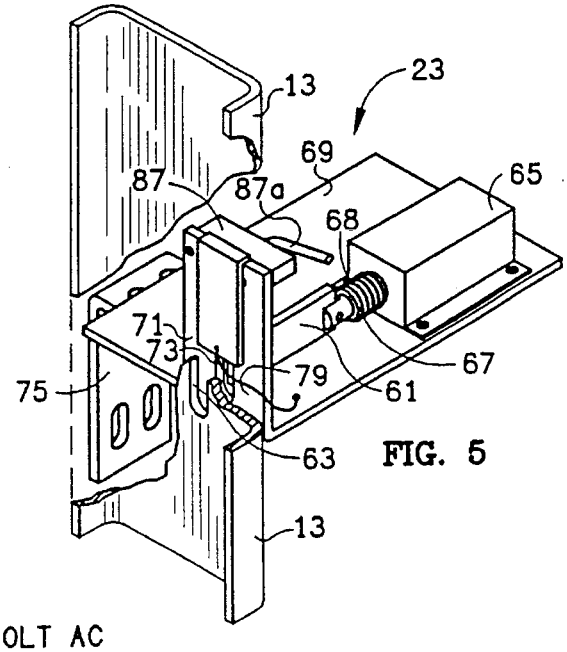
FIG. 5 is a perspective view of the assembled locking device (which was shown in exploded perspective in FIG. 2) shown installed adjacent the door track and in its disabled condition.

More specifically, the locking device, as best seen in FIGS. 2 and 5, includes a solenoid 65 having a plunger 67 that is spring-loaded by a coil spring 68 to the extended position (FIG. 2); the locking pin is affixed to the distal end of the plunger. The solenoid 65 includes the usual electromagnetic coil which causes the plunger 67 to be retracted upon the application of electric power. The solenoid assembly 65 is mounted upon a metal mounting plate 69 that includes an upstanding integral flange 71 having an elongated aperture 73 of generally oval shape which is just slightly oversized with respect to the locking pin 61. The mounting plate 69, preferably made of steel, is supported via a mounting bracket 75 having elongated holes that permit the mounting plate 69 to finely shift, horizontally and vertically, to align the oval aperture 73 both horizontally and vertically with the aperture 63 in the guide track 13. Preferably, the bracket is supported via three heavy duty wood screws or the like in the wooden post 43 that forms a portion of the door frame. A thin, disabling flat plate or element 79, having retainer lip along one edge, is attached via a flexible tie or cord 81 to the mounting plate 69. In case of a power failure, the plate 79 allows manual deactivation of the locking device 23. A microswitch 87 is mounted at the upper end of the upstanding flange 71 for the purpose of controlling the solenoid, as explained hereinafter.

As shown in FIG. 4, the locking device 23 is mounted on the wooden post adjacent the metal guide track 13, laterally outward thereof and in a position so that it will not interfere with the wire cable 50, so that, when the locking pin 61 is in its extended position, it protrudes both through the oval aperture 73 in the upstanding flange and the aperture 63 in the sidewall of the metal guide track, as best seen in FIG. 4, so that it protrudes into the trackway and thus positively blocks the path of the support rollers 31 which move therein.

Figure 6:
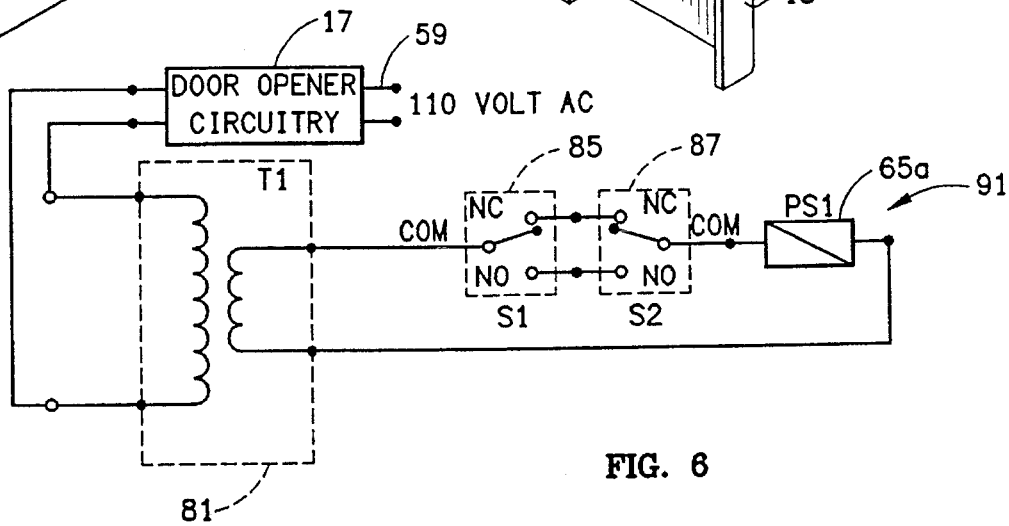
FIG. 6 is a schematic showing the electrical circuitry which is employed in the security system illustrated in the installation of FIG. 1.

To operate the solenoid 65 and allow it to carry out its unlocking function, a transformer 81 is mounted on a rafter or joist in the garage and is connected to 110 volts only when the door opener motor is being operated. The transformer 81 steps the voltage down to about 24 volts and applies this low voltage power to a wiring harness 83 which leads to a pair of microswitches 85, 87 and to the electro-magnetic coil **65*a* of the solenoid 65, all three of which are electrically interconnected as a part of an auxiliary low voltage electrical circuit 91 that is depicted in detail in FIG. 6. The overall arrangement includes the pair of microswitches 85, 87, both of which are designed to be in the normally closed position when an actuator arm 85*a*, 87*a* carried respectively by each switch is not being actuated. As can be seen in FIG. 6, the solenoid coil 65*a* obtains 24 volts of electrical power via a circuit which extends through both normally closed microswitches 85,87. Thus, any time that one of the two switches is actuated so as to cause its contacts to open, the circuit will be broken and power will be removed from the solenoid coil causing the spring-loaded plunger 67 to extend to the extended blocking position. As soon as power is again applied to the solenoid, the electromagnetic coil 65*a* causes the plunger 67 to retract, withdrawing the locking pin 61** from its blocking position in the trackway.

The microswitch 85 is mounted on a suitable mounting bracket 93, e.g. one which snaps over the metal guide track and is then fixed in place via the use of a set screw or the like. The microswitch 87 is mounted on the flange 71 of the mounting plate 69 as earlier mentioned. The microswitches 85, 87 are alternately actuated via a trip arm 95 that is of generally L-shape which is secured or fixed by a pair of screws or the like to an upper location on the rear surface of the door, as best seen in FIG. 4, so that the trip arm travels with the door. The trip arm has an outer bent lug section 95*a* that clears the upper mounting bracket 93 and likewise clears the flange 71 and engages the extending arm 87*a* from the microswitch 87 (see FIG. 3), causing it to deflect and open the switch so as to break the circuit and remove power from the solenoid. The mounting bracket 93 carrying the microswitch 85 is positioned so that the upper switch 85 will be actuated when the door is in its fully open position; this switch is mounted on the upper section 39 of the guide track near the rear end thereof. The other switch 87 is carried on the mounting plate 69 and positioned near the top of the vertical section 35 of the guide track at a location where it generally aligns with the middle of second panel from the top of the modular door. The L-shaped trip arm 95 engages the microswitches 85, 87 within the last fraction of an inch of the final movement of the door in reaching either its fully open position or its fully closed position, thereby removing electric power from the solenoid by opening the circuit shown in FIG. 6 whenever the door is in one of its two terminal positions. As best seen in FIGS. 3 and 4, the bent lug section 95*a* of the trip arm 95 extends around and past the guide track 13, engaging the switch arm 87*a* and deflecting it to cause the microswitch contacts to open.

In operation, when the door opening circuit 17 receives its signal or stimulus, usually either from a pushbutton switch or from a radio receiver upon its receipt of a coded transmission signal, the door opener motor assembly 15 is actuated so as to drive the door 11, for example, from its overhead open position to its vertical closed position. At this instant, power is also applied to the transformer 81. As soon as the door 11 begins to move, the trip arm 95 becomes disengaged from the microswitch arm 85, and the microswitch (which had been deflected to the open position) returns to its normally closed position. This instantly completes the circuit and applies 24 volts of power to the solenoid coil 65*a*, causing the immediate retraction of the locking pin 61 and allowing the garage door rollers 31 to pass the aperture 63 adjacent where the locking device 23 is positioned. The proportions of the locking device 23 are such that, in its fully retracted position, the distal end of the flat pin 61 remains within the confines of the vertical slot 73, thus assuring that misalignment cannot occur which could impede the re-insertion of the pin into the trackway.

During the closing movement of the door, the nearest roller 31 must move a fair distance downward before it reaches the region of the locking pin 61; thus, timing is not particularly crucial; however, throughout this period, the solenoid remains continuously energized, withholding the locking pin 61 from the track until the trip arm 95 engages the microswitch 87 which is positioned alongside the vertical section 35 of the track. At this point, the electrical circuit to the solenoid is again broken, and the spring-loaded plunger moves to its extended position, thus causing the locking pin 61 to protrude through the pair of aligned apertures 73, 63 and enter the pathway in the guide track 13 where further movement therepast of a roller is physically blocked. As indicated earlier, this protrusion occurs as, or just very shortly before, the door reaches its fully closed position with the usual flexible seal or the like along the lower edge of the bottom panel being in contact with the floor of the garage entrance opening. As best seen in FIG. 4, in this closed position, the locking pin 61 is located a predetermined distance above the closest roller below it, preferably a distance of about 4 to about 6 inches. This predetermined distance is important because it assures that there will be ample time to safely withdraw the locking pin 61, via the functioning of the electrical circuitry 91, before the roller 31 will reach this location as the door is being driven upward, yet the distance is not sufficient that it would permit ingress under the door by a potential intruder.

With the locking pin inserted into the trackway in this position, the security system constitutes a positive, burglar-proof, locking arrangement for such sectional garage doors which move upward and downward in a pair of flanking metal tracks. Even if a would-be thief were able to, by the astute use of a flexible steel wire element or some like instrument, snag the handle 55 and unlatch the manually detachable connector on the movable link 53 (which is provided to accommodate a loss of power), thus disconnecting the positive mechanical connection between the door and the power train, the door 11 could only be moved upward a few inches because the support roller 31 would be blocked by the protruding locking pin 61 in its path. When the roller 31 meets the lower edge of the locking pin, it can only further travel upward a fraction of an inch before the upper edge of the locking pin engages and abuts the upper edge of the oval aperture 73 in the upward bent flange 71 in the mounting plate and, depending upon alignment, perhaps also the upper edge of the aperture 63 in the guide track through which it extends. The locking pin is made of metal and is rectangular in cross section, preferably having a length at least about 4 times its width, and the aperture 73 preferably has a width not more than about twice the thickness of said pin. As a result of the close confinement of the locking pin in the oval aperture 73, the locking pin cannot be twisted or deflected so as to allow the roller 31 to move past the protruding pin that has been inserted into the guide trackway. As a result, the locking device 23 provides a positive deterrent to unauthorized entry into the garage through the overhead door so long as one cannot actuate the door opening mechanism which would provide power to the door-opener motor and the low voltage circuitry 91 and thus withdraw the locking pin 61 in the intended fashion.

When the owner wishes to enter the garage, the sending of a signal or stimulus to the door opening device, causes power to simultaneously be provided to the door opener motor assembly 15 and to the low voltage transformer 81. As a result, as the door 11 begins to move, the trip arm 95 moves out of its engagement with the arm 87*a* of the lower microswitch 87, thus allowing this switch to return to its normally closed position. As soon as the circuit to the solenoid in the auxiliary low voltage circuit is completed, the application of power to the solenoid coil 65*a* immediately retracts the plunger 67, causing the locking pin to be withdrawn by compressing the coil spring 68. Because of the positioning of the locking device 23 in alignment with an aperture 63, in the track 13 located a predetermined distance, at least about 4 inches, above the closest roller 31 therebelow, one is assured of having the pin 61 withdrawn from its blocking position before the roller travels sufficiently far enough upward where engagement could occur.

In the case of a power failure, the locking device 23 is fully accessible, and the owner can simply manually retract the locking pin 61 from its extended position, sliding it rearwardly into the solenoid 65 against the force of the coil spring to its fully retracted position where the distal end remains within the confines of the vertical slot 73. In this position, a thin disabling plate or element 79, which preferably hangs from the mounting plate 69 via a flexible cable or tie 81, is placed or inserted into the open space 98 (see FIG. 3) left between the upstanding flange 71 and the wall of the track 13 where it lies perpendicular to the pin, between the flange 71 and the track, as shown in FIG. 5, prevented from slipping out of position by the retainer lip, so that it prevents the locking pin from entering into the blocking position. After disabling the locking device 23 by the insertion of the plate 79 (see FIG. 5), the owner can disengage the traveler link 53 from the roller chain and manually raise the door so as to allow a vehicle to either exit or enter the garage.

Although the invention has been described in respect of a certain preferred construction which constitutes the best mode presently known to the applicant, it should be understood that various modifications and changes as would be obvious to one having the ordinary skill in this art may be made without departing from the scope of the invention which is defined by the appended claims. As noted above, the invention is not limited to use with a particular type of door opener assembly; it can be used with various well known types of automatic openers, e.g. with an elongated, threaded screw-type opener drive train as well as with the illustrated roller chain-type drive chain.

Particular features of the invention are emphasized in the claims which follow.

What is claimed is:

1. An automatically operable garage door installation incorporating a security system to guard against unauthorized entry, which installation comprises:

a multi-sectional garage door for closing the vehicle entrance into an area in a structure large enough to accommodate an automotive vehicle, which door includes a plurality of generally similar horizontally extending panels, which panels are hinged together along the upper and/or lower edges thereof to constitute a solid barrier to entry through said entrance, said door being supported via a plurality of rotatable rollers mounted on shafts generally extending from locations near the lateral edges of said door, a pair of flanking, longitudinally extending, supporting tracks which have trackways wherein said rollers are received, said tracks being located so as to guide said door for travel to and from between a vertical position where said entrance is closed and an upper horizontal position where said entrance is sufficiently open to allow a vehicle to be driven therethrough, one of said tracks having at least a first aperture in a sidewall thereof;

a detent a bracket mounting said detent for movement between a first position across said track and into said aperture and to a retracted position;

a spring biasing said detent toward said first position;

electromagnetic means for moving said detent to said retracted position;

a door-operating mechanism which includes an electric drive motor for moving said door between said upper open position and said lower closed position;

means for energizing said electromagnetic means whenever electrical power is supplied to said electric motor through said first electric circuit means to thereby cause said detent to be withdrawn from said trackway to said retracted position;

said means for energizing including two limit switches which are located along said track and which are operable to remove electrical power from said electromagnetic means upon said door reaching about either its fully open position or its fully closed position, whereby said spring biases said detent to said first position when the door reaches its fully closed position thereby preventing unauthorized opening of the door because any significant upward movement of said door causes a roller in said trackway to engage said detent which physically obstructs its passage so that any further upward opening movement of the door is not possible.

2. A garage door installation according to claim 2 wherein said detent is elongated in cross-section having a substantially longer dimension in the vertical direction.

3. A garage door installation according to claim 2 wherein said detent has a longitudinal length such that its distal end remains confined in said aperture in said retracted position.

4. A garage door installation according to claim 3 wherein said bracket has a second aperture that has an elongated shape having a width less than about twice the thickness of said detent through which said detent extends in both the first and retracting position.

5. A garage door installation according to claim 3 wherein a disabling element is provided and movably connected with said mounting plate, which disabling element is insertable into a vertical region between said track sidewall and said vertical flange where it blocks access to said aperture in said track and thereby prevents penetration of said detent means into said trackway after it has been manually withdrawn.

6. A garage door installation according to claim 2 wherein lug means are carried by said door;

said limit switches are engaged by said lug means carried by said door as said door reaches about either its fully open position or its fully closed position.

* * * * *